US006172343B1

(12) United States Patent
Nothe et al.

(10) Patent No.: US 6,172,343 B1
(45) Date of Patent: Jan. 9, 2001

(54) HEATER AND HEATER CONTROL WITH SELECTIVE POWER RATING

(75) Inventors: William E. Nothe, Florence, SC (US); John R. Wrenn, Raleigh, NC (US)

(73) Assignee: Marley Electric Heating, Bennettsville, SC (US)

( * ) Notice: Under 35 U.S.C. 154(b), the term of this patent shall be extended for 0 days.

(21) Appl. No.: 09/037,072

(22) Filed: Mar. 9, 1998

(51) Int. Cl.[7] ..... H05B 1/02

(52) U.S. Cl. ..... 219/501; 219/480; 338/195; 338/295

(58) Field of Search ..... 219/209, 210, 219/501–505, 486, 483; 361/794; 35/29 R; 310/71, 87, 89; 338/195, 295, 320

(56) References Cited

U.S. PATENT DOCUMENTS

| | | | | |
|---|---|---|---|---|
| 743,654 | * | 11/1903 | McElroy . | |
| 1,215,427 | * | 2/1917 | Stocker | 219/480 |
| 1,346,793 | * | 7/1920 | Gates | 219/480 |
| 1,932,650 | * | 10/1933 | Weiscopf | 338/295 |
| 4,198,768 | * | 4/1980 | Wahl et al. | 35/29 R |
| 4,298,856 | * | 11/1981 | Schuchardt | 338/195 |
| 4,547,689 | * | 10/1985 | Tsuchimoto et al. | 310/71 |
| 4,786,799 | * | 11/1988 | Welle, Jr. et al. | 219/486 |
| 4,902,877 | * | 2/1990 | Grasso et al. | 219/483 |
| 5,113,480 | * | 5/1992 | Murphy et al. | 392/501 |
| 5,162,635 | * | 11/1992 | Sato et al. | 219/216 |
| 5,293,148 | * | 3/1994 | Hancock | 338/295 |
| 5,428,339 | * | 6/1995 | Das | 338/195 |
| 5,438,914 | * | 8/1995 | Hohn et al. | 99/327 |
| 5,587,887 | * | 12/1996 | Price et al. | 361/794 |

OTHER PUBLICATIONS

Marley Electric Heating Catalog, pp. 4 & 5, Feb. 16, 1996.

* cited by examiner

*Primary Examiner*—Teresa Walberg
*Assistant Examiner*—Jeffrey Pwu
(74) *Attorney, Agent, or Firm*—Nelson Mullins Riley & Scarborough, LLP

(57) ABSTRACT

A heater having selective power rating includes a source of electric current, at least one heating unit and at least one electric conductor having an input and an output. Each conductor is permanently fixed at its input and its output so that the conductor is in electric communication with the source. Each conductor is in one of two states. In a conducting state, the conductor is electrically continuous between its input and its output. In a nonconducting state, the conductor is severed between its input and its output. A first conductor is disposed with respect to the source and a first heating unit so that the first heating unit operates at a power level that is dependent on the state of the first conductor. The source and the at least one heating unit are configured to produce one of a plurality of a desired power levels depending on the state of the first conductor.

24 Claims, 5 Drawing Sheets

HEATER AND HEATER CONTROL WITH SELECTIVE POWER RATING

BACKGROUND OF THE INVENTION

The present invention relates to residential and commercial heaters. More particularly, the invention relates to improvements in heaters manufactured to have power ratings which may be selected at the time of installation.

The power requirements for a heater in a given location may depend on various factors peculiar to the location, such as the volume of the heated area and the electrical capacity at the location. To increase efficiency for the manufacturer and flexibility for the contractor, heaters have been manufactured with a plurality of heating units, for example including resistive elements, connected to an electric current source by selective couplings. Typically, these couplings are wire jumpers which can be attached and detached to connections at the heating elements by hand in predetermined patterns. The connection may be made, for example, by a clip that requires greater force to detach than to attach.

Depending on the jumper pattern, the elements are arranged, for example in series or parallel, with respect to the current source so that the heater operates at a predetermined power rating. In some arrangements, a jumper may be removed to electrically isolate one or more elements within the system. The jumpers are coded in some manner, for example by color, so that a contractor may easily arrange the jumpers in a given pattern provided in an instruction set to produce the desired result.

SUMMARY OF THE INVENTION

The present invention recognizes and addresses disadvantages of prior art construction and the methods.

Accordingly, it is an object of the present invention to provide an improved heater system.

More particularly, it is an object of the present invention to provide an improved heater having selective power ratings.

Still further, it is an object of the present invention to provide a heater having a power rating selected by severance of a predetermined one or more permanently attached conductors.

Some of these objects are achieved by a heater having selective power rating. The heater includes a source of electric current and at least one heating unit. At least one electric conductor has an input and an output. Each conductor is permanently fixed at the input and output so that the conductor is in electric communication with the source. Each conductor is in one of two states. In a conducting state, the conductor is electrically continuous between its input and its output. In a nonconducting state, the conductor is severed between its input and its output. A first conductor is disposed with respect to the source and with a first heating unit so that the first heating unit operates at a power level that is dependent on the state of the first conductor. The source and the at least one heating unit are configured to produce one of a plurality of desired power levels depending on the state of the first conductor.

The accompanying drawings, which are incorporated in and constitute a part of the specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings in which.

Figure 1:
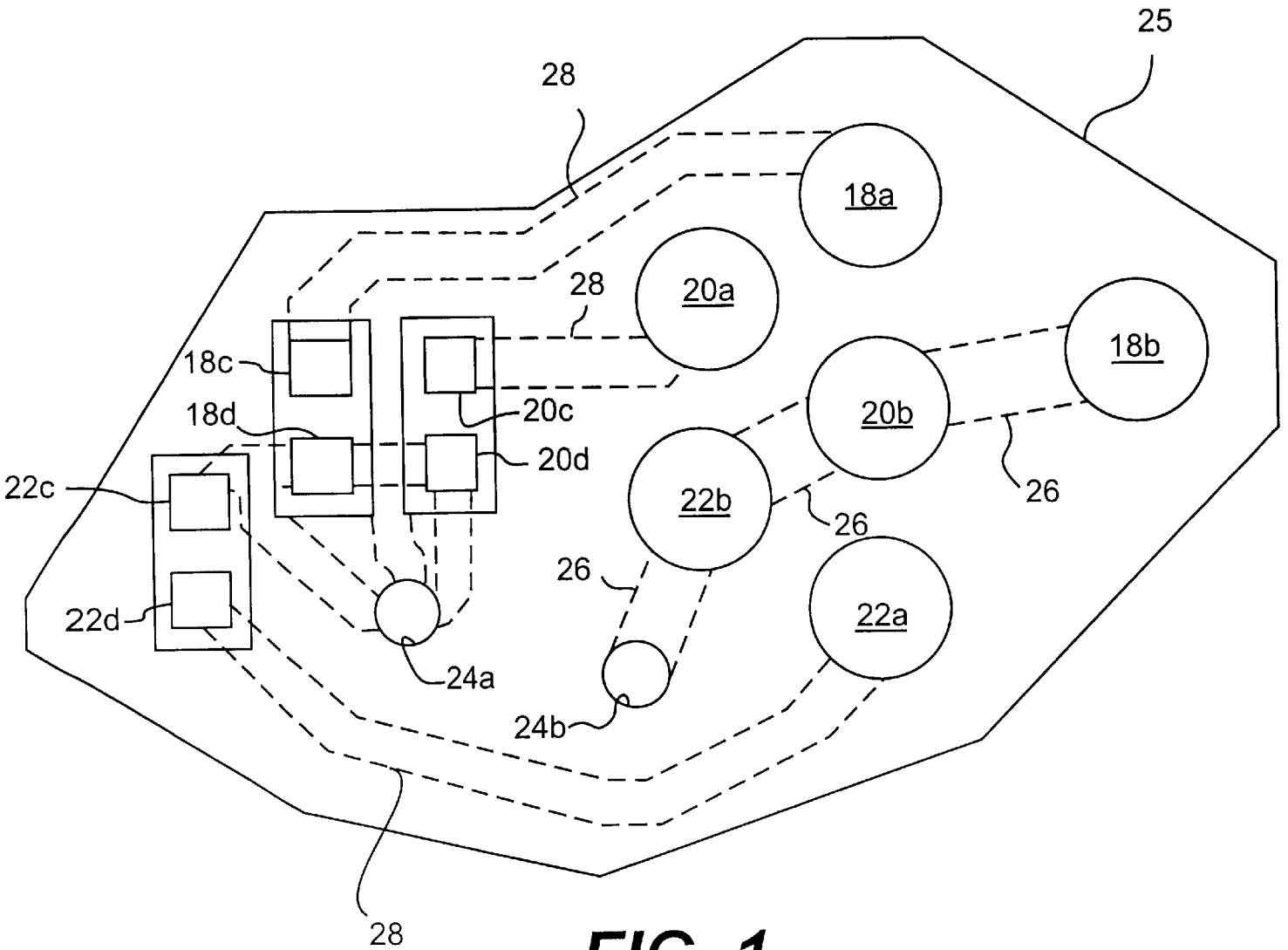
FIG. 1 is a diagrammatic view of a connection board for use in an embodiment of a heater in accordance with the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2A:
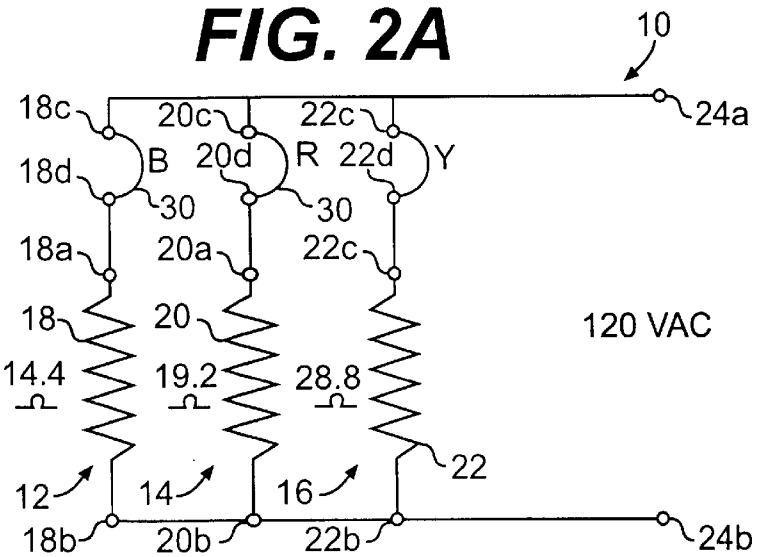
FIG. 2A is a schematic illustration of an embodiment of a heater in accordance with the present invention using the connection board shown in FIG. 1.

The present invention is concerned with a heater having a selective power rating. Accordingly, FIG. 2A schematically illustrates a heater 10 having three heating units indicated at 12, 14 and 16. Each heating unit may be any suitable device driven by electric current to produce heat and in the illustrated embodiment includes a respective resistive element 18, 20 or 22. The resistive elements are heating unit components that produce heat due to resistance to electric current flow and are therefore treated in FIG. 2A as resistances. For example, the resistance of a coiled element depends on the coil's thickness and length. The construction of the elements, however, should be well understood in this art and is not described in detail herein. Examples of resistive elements that may be used with the present invention include nichrome open coiled, sheathed, finned, EICHENAUER, hydronic or ribbon elements.

Each heating unit includes a connection board 25 as shown in FIG. 1. In this case, a unitary connection board is used for all heating units 12, 14 and 16. Referring to FIGS. 1 and 2A, connection board 25 is a printed circuit board which may be constructed from an epoxy laminate. The construction of printed circuit boards should be well understood and is not described in detail herein. For example, any suitable material, such as FR4 and ED130, may be used to construct the board. Since the board is exposed to heat, other suitable materials such as FR5 or FR406 may also be used.

FIG. 1 illustrates the physical layout of board 25, at which various components of heater 10 are electrically connected. Components may be connected by any suitable method, for example by soldering, brazing or welding. Resistive element 18 is electrically connected at holes 18*a* and 18*b* in FIG. 2A as indicated at nodes 18*a* and 18*b* in FIG. 1. Similarly, resistive elements 20 and 22 are connected at holes 20*a*–20*b* and 22*a*–22*b*, respectively. A 120 volt source is applied across nodes 24*a* and 24*b* to provide electric current to resistive elements 18, 20 and 22. While a single phase voltage source is illustrated in the figures, it should be understood that a three phase arrangement could also be employed.

As illustrated in the figures and as discussed in the examples below, a 120 volt source is established across 24*a*–24*b*. Accordingly, node 24*a* may be applied to a 120 volt AC line, while node 24*b* is applied to a neutral line. To achieve a 240 volt source, nodes 24*a* and 24*b* are applied to 120 volt lines that are 180° out of phase. To achieve 208 volts, the nodes are applied to 120 volt lines that are 120° out of phase. Thus, while the examples provided herein employ a 120 volt source to achieve desired power ratings, it should be understood that other voltage levels may be employed. The resistance levels and disposition of the heating units may be chosen to provide desired power ratings for the voltage level in a given configuration.

It should be understood that the direction of current flow is not a limitation to the present invention. As discussed in more detail below, for example, wire jumpers are disposed electrically between the current source and respective resistive elements 18, 20 and 22. Whether current flows from the source into a heating element through its jumper, or from the source directly to the heating element and out of the heating element through the jumper, the source provides electric current to the element through the jumper.

Referring again to FIG. 1, the current source is electrically connected to printed circuit board 25 by an appropriate joint, such as a weld or solder joint, at 24*a* and 24*b*. Electric connections are made on printed circuit board 25 through traces indicated by dashed lines. Thus, assuming node 24*b* is neutral, the output nodes 18*b*, 20*b* and 22*b* are electrically tied to neutral by trace 26. Elements 18, 20 and 22 are electrically connected to trace 26 at the holes in board 25 at 18*b*, 20*b* and 22*b* by a suitable joint, such as a solder or weld. The deposition of traces on a printed circuit board should be understood and is therefore not described herein.

Each resistive element is attached to board 25 at its other end at a respective hole 18*a*, 20*a* or 22*a* and communicates with the 120 volt current source node 24*a* over respective traces 28. Each trace 28 is interrupted by a gap, at respective nodes 18*c*–18*d*, 20*c*–20*d* and 22*c*–22*d*, that is bridged by a jumper 30. Each jumper is connected at its input end to board 25 at a respective hole 18*c*, 20*c* or 22*c*, and at its output end at a respective hole 18*d*, 20*d* or 22*d*, by a suitable joint such as a solder or weld so that electric current flows from the current source to the resistive elements over traces 28.

Each jumper 30 is connected to the current source and its respective resistive element through traces 28 so that the jumper cannot be removed from the connection by hand, without breaking a bond (such as a weld, braze or solder bond) between the connection and the source or resistive element, or without at least partially damaging or disassembling the connection surface or heating unit. Thus, for example, the jumpers may be soldered on both sides of board 25 at connections 18*c*–18*d*, 20*c*–20*d* and 22*c*–22*d*. Removal of a jumper, without at least partial destruction of the board, would therefore require both the removal of board 25 from the heating unit and the use of a soldering iron to remove the bond on either side. Each jumper may be bonded by a solder, braze or weld to board 25 on either side of the board alone. Further, each jumper may be attached to the rear side of board 25 by a clip device that, although that it may be disconnected by hand, would require disassembly of the board from the units.

In one preferred embodiment, each jumper 30 is an electrically conductive wire, for example made of copper and surrounded by a suitable covering. Each jumper is exposed. That is, it is accessible to means for severing the jumper. Where wire is used, each wire may extend from board 25 in a loop so that it is accessible to wire cutters. The present invention is not limited to wire jumpers, however, and it should be understood that any suitable jumper may be used. For example, where the jumper is a trace section integrally constructed with a trace 28, it may be disposed at a position on the board at which it may be cut by a laser or punched by a punching tool. Where the heating units are enclosed by a housing, a removable or openable grating or cover may be disposed over board 25 to provide access to the board for severing the jumpers.

Before being severed, each jumper is electrically continuous so that electric current is provided from the source to the jumper's resistive element. Each conductor 30 is illustrated in FIG. 2A in such a conducting state. As indicated in the figure, the resistance of elements 18, 20 and 22 is 14.4 ohms, 19.2 ohms and 28.8 ohms, respectively. Since the current source provides current to all three elements, the equivalent resistance seen by the current source is 6.4 ohms. Thus, the power rating of heater 10 is approximately 2200 watts. The power rating may refer to any suitable measure of the heater's power input or output that depends at least in part on the heating units. Generally, the discussion herein relates to output power. Since the heating units illustrated in the figures are primarily resistive, the input power and output power are substantially the same. It should be understood, however, that other components may be placed within the circuitry that may affect the power rating. For example, a motorized fan may be disposed in parallel across nodes 24*a* and 24*b*. The electrical effect of such components may be taken into account in designing the heater to achieve the desired power ratings.

When a jumper is severed, the heater's power rating changes. Severing a second jumper results in yet another power rating. Thus, the heater's power rating depends on the state of all jumpers at any given time. While it is possible to simply cut a wire jumper, it may be preferable to cut the wire at both its input and output ends near board 25 (FIG. 1).

The power outputs of any given heating unit under any combination of jumper states is known in that the unit's resistance and the input voltage/current are known. Although resistance for the elements is typically constant, the current input to each may change, for example where two or more elements are disposed in a series arrangement with each other with respect to the current source, depending on the jumper arrangement. The current is predictable, however, through basic circuit analysis techniques, and therefore the power output of the element in any combination is known.

Figure 2B:
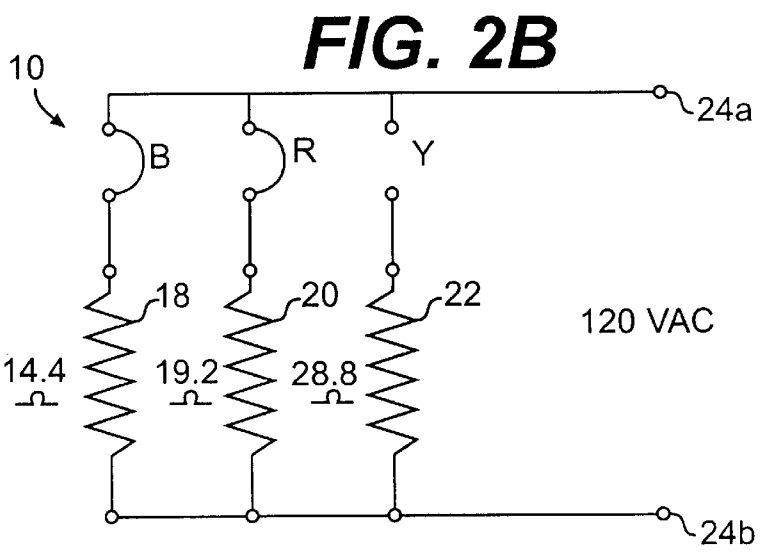
FIG. 2B is a schematic illustration of an embodiment of a heater in accordance with the present invention using the connection board shown in FIG. 1.

For example, referring now to FIG. 2B, the jumper in series with element 22 with respect to the source is severed. The equivalent resistance seen by the current source is approximately 8.23 ohms, and the power rating is approximately 1750 watts. The power output of resistive element 20 is approximately 750 watts, while the power output of resistive element 18 is approximately 1000 watts. The 500 watts contributed by element 22 in FIG. 2A is removed in the arrangement of FIG. 2B, accounting for the power rating difference between the two arrangements.

Various other power ratings may be achieved by selectively by severing one or more of the jumpers. To aid in the identification of the appropriate jumper, each jumper is coded, for example by coloring of its coating. In the embodiment shown in FIGS. 2A–2G, the wire jumpers are colored blue, red and yellow as indicated at B, R and Y. It should be understood, however, that any suitable coding technique may be used.

Figure 2C:
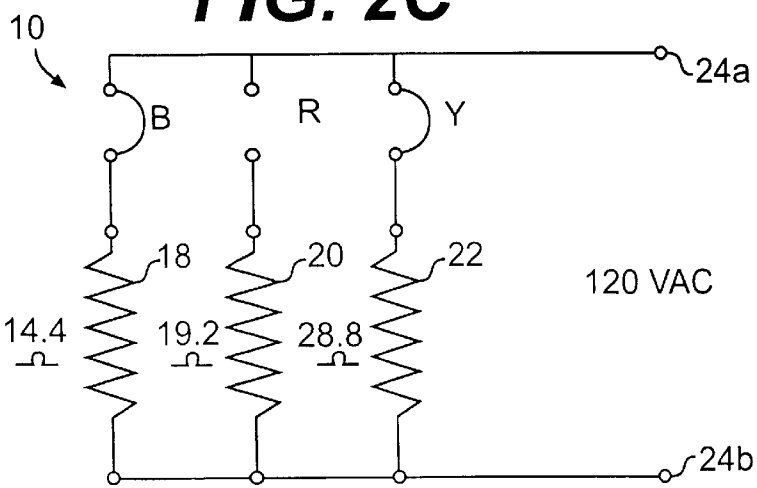
FIG. 2C is a schematic illustration of an embodiment of a heater in accordance with the present invention using the connection board shown in FIG. 1.
Figure 2D:
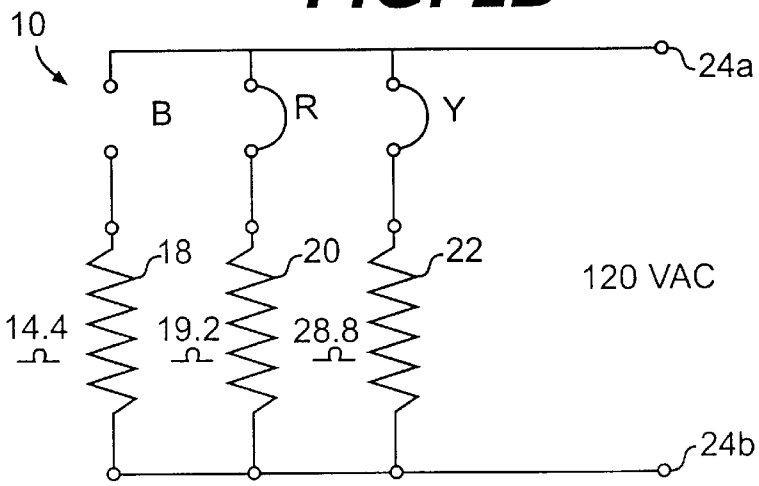
FIG. 2D is a schematic illustration of an embodiment of a heater in accordance with the present invention using the connection board shown in FIG. 1.
Figure 2F:
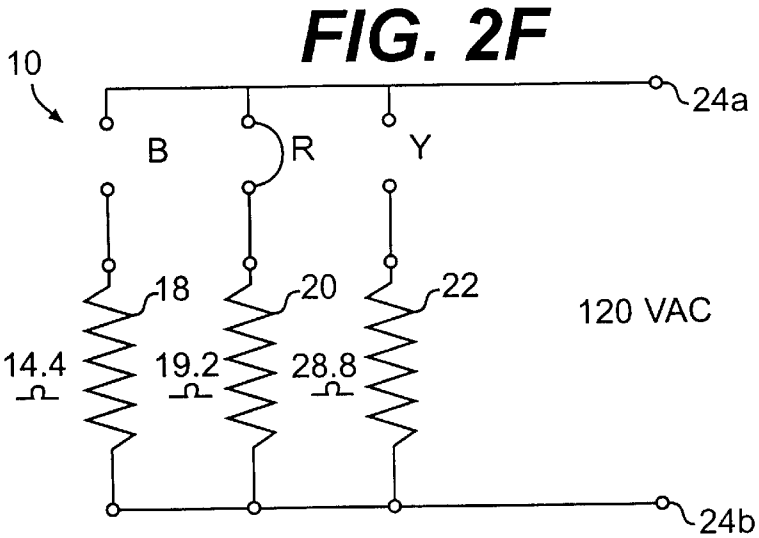
FIG. 2F is a schematic illustration of an embodiment of a heater in accordance with the present invention using the connection board shown in FIG. 1.
Figure 2E:
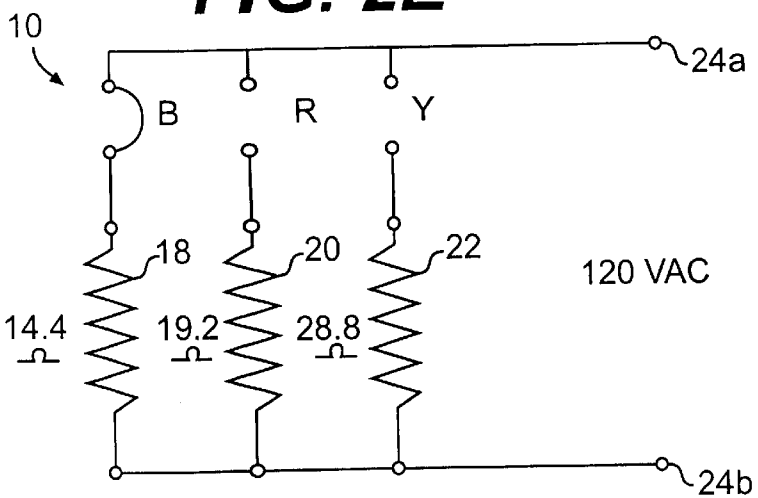
FIG. 2E is a schematic illustration of an embodiment of a heater in accordance with the present invention using the connection board shown in FIG. 1.
Figure 2G:
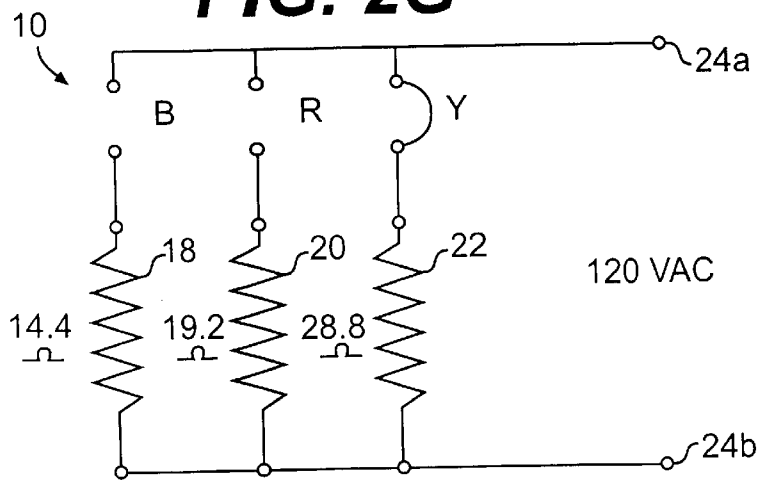
FIG. 2G is a schematic illustration of an embodiment of a heater in accordance with the present invention using the connection board shown in FIG. 1.

The red jumper is severed in FIG. 2C, removing 750 watts from the arrangement illustrated in FIG. 2D so that the heater power rating is 1500 watts. In FIG. 2D, the blue jumper is severed, resulting in a power rating of 1250 watts.

As noted above, more than one jumper may be severed to provide a desired power rating. Thus, in FIG. 2E, the red and yellow jumpers are severed to provide a 1000 watt power rating, while 750 watt and 500 watt power ratings are achieved in FIGS. 2F and 2D, respectively. Where one or more additional heating units are included within heater 10, all three jumpers may be severed so that current is provided only to those units.

Figure 3:
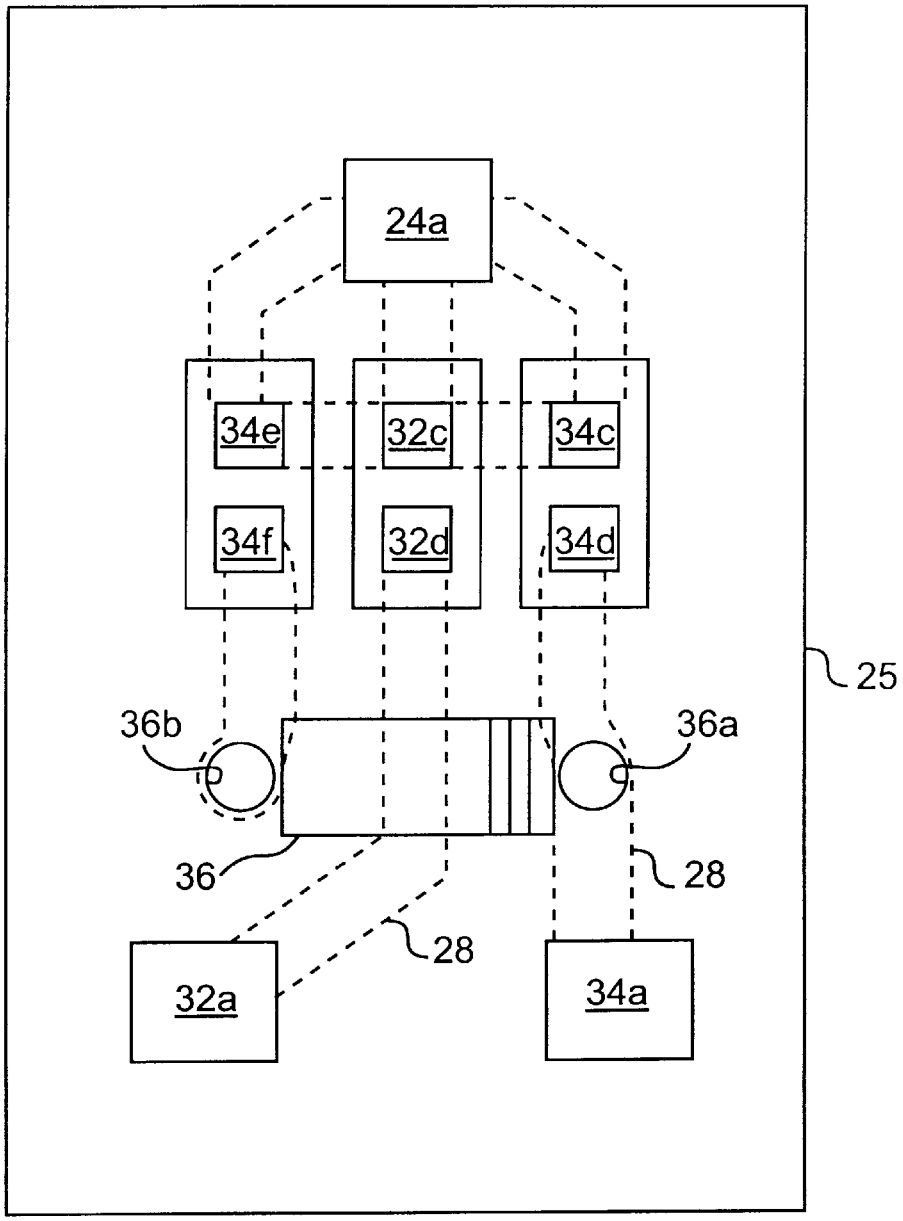
FIG. 3 is a diagrammatic view of a connection board for use in an embodiment of a heater in accordance with the present invention.
Figure 4A:
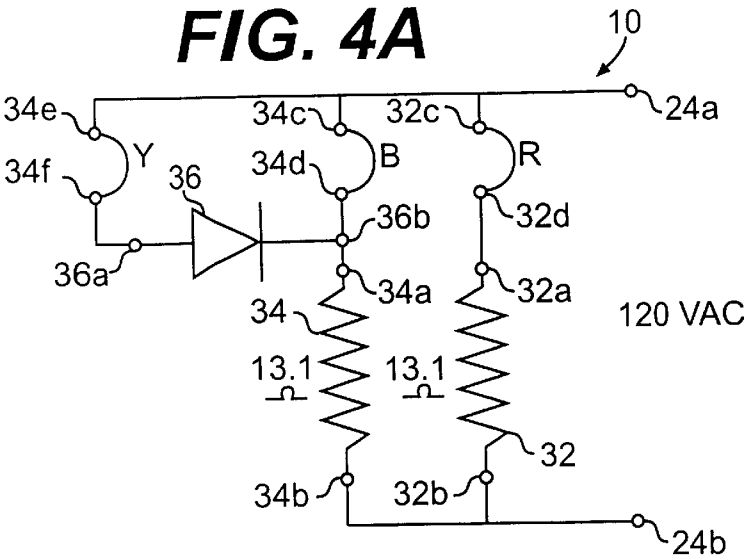
FIG. 4A is a schematic illustration of an embodiment of a heater in accordance with the present invention using the connection board shown in FIG. 3.

Another preferred embodiment of the present invention is illustrated schematically in FIG. 4A. The heating unit 10 includes a pair of resistive elements 32 and 34 attached at nodes 32*a*–32*b* and 34*a*–34*b*, respectively, on a printed circuit board 25 shown in FIG. 3. Resistive elements 32 and 34 are operatively connected to the 120 volt current source at nodes 24*a* and 24*b*. In this embodiment, the elements are directly wired to a neutral line, and the neutral node 24*b* is therefore not connected at board 25.

The resistive element inputs are attached at holes in board 25 by a suitable connection such as a wave solder bond at nodes 32*a* and 34*a*. Traces 28 electrically connect these nodes to nodes 32*d* and 34*d*, which are connected by red and blue jumpers to nodes 32*c* and 34*c*, respectively. These nodes are connected, in turn, to current source node 24*a* so that when the jumpers are in the conducting state, electric current is provided to the resistive element.

A diode 36 is connected in series with resistive element 34, and in parallel with the blue jumper across nodes 34*c* and 34*d*, with respect to the current source. Diode 36 is attached to board 25 at nodes 36*a* and 36*b* as shown in FIG. 3 by any suitable means such as soldering or welding. The input to diode 36 is attached to current source input node 24*a* through a yellow wire jumper attached to board 25 at nodes 34*e* and 34*f*. Thus, the yellow jumper is connected to element 34 through diode 36.

Figure 4B:
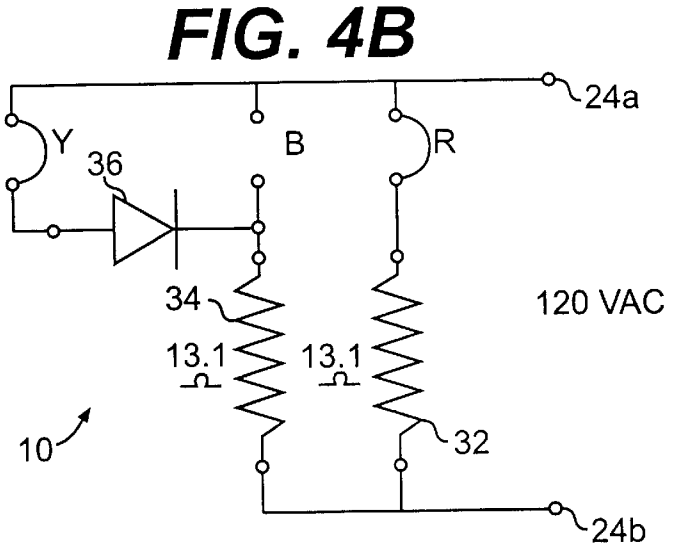
FIG. 4B is a schematic illustration of an embodiment of a heater in accordance with the present invention using the connection board shown in FIG. 3.

When all three jumpers are in a conducting state as shown in FIG. 4A, the blue jumper shorts the yellow jumper and diode 36. Given that the resistance of each resistive element is approximately 13.1 ohms, the power rating for heater 10 is approximately 2200 watts. When the blue jumper is severed as shown in FIG. 4B, however, diode 36 acts as a half-wave rectifier, and current is provided to resistive element 34 only at every other half-cycle. Thus, during one half-cycle, the heater's output power is approximately 1100 watts, while during the other half-cycle the power output is approximately 2200 watts, resulting in an effective power rating of 1650 watts.

Figure 4C:
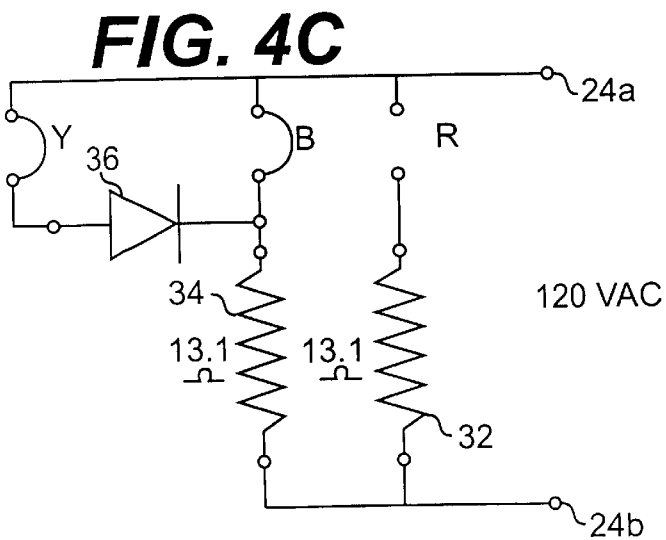
FIG. 4C is a schematic illustration of an embodiment of a heater in accordance with the present invention using the connection board shown in FIG. 3.
Figure 4D:
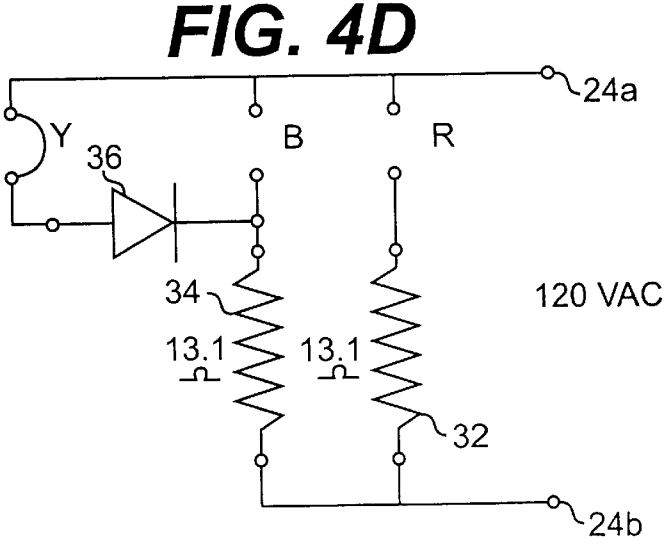
FIG. 4D a schematic illustration of an embodiment of a heater in accordance with the present invention using the connection board shown in FIG. 3.

Referring to FIG. 4C, diode 36 is again shorted by the blue jumper. Since the red jumper is severed, the effective resistance seen by the current source is approximately 13.1 ohms, resulting in a power rating of 1100 watts. In FIG. 4D, the blue and red jumpers are severed. Since current is provided to resistive element 34 at every other half-cycle, the power rating of the heater is 550 watts.

The power rating examples provided herein assume ideal components. It should be understood that these numbers are approximations, since actual operative values vary within known parameters. For example, diode 36 is not a perfect half-wave rectifier and generally varies from a 50% cut off level by approximately 2%.

While preferred embodiments of the invention have been described above, it should be understood that any and all equivalent realizations of the present invention are included within the scope and spirit thereof. For example, the current source may not be a unitary source and may comprise two or more discrete sources supplying current to discrete heating units or elements. Further, various suitable components may be included within the heater as desired. For example, an automatic reset over-temperature device may be disposed in line with one or both of nodes 24*a* and 24*b* to disconnect the current source in case of an overload or overheating condition. Thus, the embodiments depicted are presented by way of example only and are not intended as limitations upon the present invention. It should be understood by those of ordinary skill in this art that the present invention is not limited to these embodiments since modifications can be made. Therefore, it is contemplated that any and all such embodiments are included in the present invention as may fall within the literal or equivalent scope of the appended claims.

What is claims is:

1. A heater having selective power rating, said heater comprising:

an electrical connection to a source of electric current;

a plurality of heating units; and a plurality of non-selective electrical paths connecting said electrical connection to respective said heating units, wherein at least one said path includes a non-selective electric conductor having an input and an output, said conductor being permanently fixed at said input and said output to said path so that said conductor is in electric communication with said electrical connection, wherein said conductor is in one of two states, a conducting state, in which said conductor is electrically continuous between its said input and its said output, and a nonconducting state, in which said conductor is severed between its said input and its said output, wherein a first said conductor is disposed with respect to said source and a first said heating unit so that said first heating unit operates at a power level that is dependent on said state of said first conductor, and wherein said plurality of heating units are configured with respect to said source to produce one of a plurality of desired power levels depending on said state of said first conductor.

2. The heater as in claim 1, wherein said first conductor is electrically in series with said first heating unit and said electrical connection.

3. The heater as in claim 2, wherein said first conductor is connected between said electrical connection and only one said heating unit.

4. The heater as in claim 2, where only one said conductor is connected between said electrical connection and said first heating unit.

5. The heater as in claim 1, including a second said conductor disposed with respect to said source and a second said heating unit so that said second heating unit operates at a power level that is dependent on said state of said second conductor, wherein said plurality of heating units are configured with respect to said source to produce one of a plurality of desired power levels depending on said states of said first conductor and said second conductor.

6. The heater as in claim 1, wherein said first heating unit includes a resistive heating element.

7. The heater as in claim 1, including a connection board that defines said path and said electrical connection, wherein said conductor input and said conductor output are permanently fixed to said board and wherein said source and said first heating unit are electrically connected to said board in electrical communication with said first conductor.

8. The heater as in claim 7, wherein said connection board is a printed circuit board.

9. The heater as in claim 8, wherein said conductor is soldered to said board at said input and said output.

10. The heater as in claim 9, wherein said board has a top surface and a back surface opposite said front surface, and wherein said conductor is soldered to said board at said front surface and at said back surface.

11. The heater as in claim 5, wherein said first heating unit is electrically in parallel with said second heating unit with respect to said electrical connection, wherein said first conductor is electrically in series with said first heating unit with respect to said electrical connection, and wherein said second conductor is electrically in series with said second heating unit with respect to said electrical connection.

12. The heater as in claim 11, including a third said conductor disposed electrically in parallel with said second conductor, and electrically in series with said second heating unit, with respect to said electrical connection, and a half-wave rectifier disposed electrically in parallel with said second conductor, and electrically in series with said third conductor and said second heating unit, with respect to said electrical connection, so that said second heating unit operates at a power level that is dependent on said state of said second conductor and said third conductor, and wherein said plurality of heating units are configured with respect to said source to produce one of a plurality of desired power levels depending on said states of said first conductor, said second conductor and said third conductor.

13. The heater as in claim 12, wherein said half-wave rectifier includes a diode.

14. The heater as in claim 11, including a third said heating unit disposed electrically in parallel with said second heating unit and said first heating unit with respect to said electrical connection, and a third said conductor disposed electrically in series with said third heating unit with respect to said electrical connection, wherein said plurality of heating units are configured with respect to said source to produce one of a plurality of desired power levels depending on said states of said first conductor, said second conductor and said third conductor.

15. A heater having selective power rating, said heater comprising:

an electrical connection to a source of electric current;

a plurality of resistive heating elements;

a connection board on which said electrical connection is defined and to which a first said heating element is electrically connected;

a plurality of non-selective electrical paths on said connection board connecting said electrical connection to respective said heating units, wherein at least one said path includes a non-selective electrically conductive jumper, said jumper being permanently fixed to a said path at a first end of said jumper and at a second end of said jumper so that said jumper is in electric communication with said source, wherein said jumper is in one of two states, a conducting state, in which said jumper is electrically continuous between its said first end and its said second end, and a nonconducting state, in which said jumper is severed between its said first end and it said second end, wherein a first said jumper is disposed with respect to said source and a first said heating element so that said first heating element operates at a power level that is dependent on said state of said first jumper, and wherein said plurality of heating elements are configured with respect to said source to produce one of a plurality of desired power levels depending on said state of said first jumper.

16. The heater as in claim 15, wherein said jumper is a wire jumper.

17. The heater as in claim 15, wherein said connection board is a printed circuit board.

18. The heater as in claim 15, including a second said jumper disposed with respect to said electrical connection and a second said heating element electrically connected to said connection board so that said second heating element operates at a power level that is dependent on said state of said second jumper, wherein said plurality of heating elements are configured with respect to said source to produce one of a plurality of desired power levels depending on said states of said first jumper and said second jumper.

19. The heater as in claim 18, wherein said first heating element is electrically in parallel with said second heating element with respect to said electrical connection, wherein said first jumper is electrically in series with said first heating element with respect to said electrical connection, and wherein said second jumper is electrically in series with said second heating element with respect to said electrical connection.

20. The heater as in claim 19, including a third said jumper disposed electrically in parallel with said second jumper, and electrically in series with said second heating element, with respect to said electrical connection, and a half-wave rectifier disposed electrically in parallel with said second jumper, and electrically in series with said third jumper and said second heating element, with respect to said electrical connection, so that said second heating element operates at a power level that is dependent on said state of said second jumper and said third jumper, and wherein said plurality of heating elements are configured with respect to said source to produce one of a plurality of desired power levels depending on said states of said first jumper, said second jumper and said third jumper.

21. The heater as in claim 20, wherein said half-wave rectifier includes a diode.

22. The heater as in claim 19, including a third said heating element electrically connected to said connection board and disposed electrically in parallel with said second heating element and said first heating element with respect to said electrical connection, and a third said jumper disposed electrically in series with said third heating element with respect to said electrical connection, wherein said plurality of heating elements are configured with respect to said source to produce one of a plurality of desired power levels depending on said states of said first jumper, said second jumper and said third jumper.

23. A heater having selective power rating, said heater comprising:

an electrical connection to a source of electric current;

at least two resistive heating elements;

a connection board on which said electrical connection is defined and to which a first said heating element and a second said heating element are electrically connected;

a plurality of non-selective electrical paths on said connection board connecting said electrical connection to respective said heating elements, wherein each of at least three said paths includes a non-selective electrically conductive wire jumper, said jumper being permanently fixed to said connection board at a first end of said jumper and at a second end of said jumper so that said jumper is in electric communication with said electrical connection, wherein each said jumper is in one of two states, a conducting state, in which said jumper is electrically continuous between its said first end and its said second end, and a nonconducting state, in which said jumper is severed between its said first end and it said second end, wherein said first heating element and said second heating element are electrically in parallel with each other with respect to said electrical connection, wherein a first said jumper is disposed electrically in series with respect to said electrical connection and said first heating element, wherein a second said jumper is disposed electrically in series with respect to said electrical connection and said second heating element, wherein a third said jumper is disposed electrically in parallel with said second jumper, and electrically in series with said second heating element, with respect to said electrical connection, and wherein said at least two heating elements are configured with respect to said source to produce one of a plurality of desired power levels depending on said states of said first jumper, said second jumper and said third jumper.

24. A heater having selective power rating, said heater comprising:

an electrical connection to a source of electric current;

at least three resistive heating elements;

a connection board on which said electrical connection is defined and to which a first said heating element, a second said heating element and a third said heating element are electrically connected;

a plurality of non-selective electrical paths on said connection board connecting said electrical connection to respective said heating elements, wherein each of at least three said paths includes a non-selective electrically conductive wire jumper, said jumper being permanently fixed to said connection board at a first end of said jumper and at a second end of said jumper so that said jumper is in electric communication with said electrical connection, wherein each said jumper is in one of two states, a conducting state, in which said jumper is electrically continuous between its said first end and its said second end, and a nonconducting state, in which said jumper is severed between its said first end and it said second end, wherein said first heating element, said second heating element and said third heating element are electrically in parallel with each other with respect to said source, wherein a first said jumper is disposed electrically in series with respect to said electrical connection and said first heating element, wherein a second said jumper is disposed electrically in series with respect to said electrical connection and said second heating element, wherein a third said jumper is disposed electrically in series with respect to said electrical connection, and said third heating element, wherein said at least three heating elements are configured with respect to said source to produce one of a plurality of desired power levels depending on said states of said first jumper, said second jumper and said third jumper.

* * * * *